US006736677B1

(12) United States Patent
Lin et al.

(10) Patent No.: US 6,736,677 B1
(45) Date of Patent: May 18, 2004

(54) CABLE END CONNECTOR ASSEMBLY WITH IMPROVED GROUNDING MEANS

(75) Inventors: Hsien-Chu Lin, Tu-Chen (TW); Yung-Chien Chung, Tu-chen (TW); Chieh Chao Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/328,793

(22) Filed: Dec. 23, 2002

(30) Foreign Application Priority Data

Dec. 13, 2002 (TW) ..... 91220215 U

(51) Int. Cl.[7] ..... H01R 13/648
(52) U.S. Cl. ..... 439/610; 439/607; 439/939
(58) Field of Search ..... 434/607, 609, 434/610, 545, 564, 939, 701, 108

(56) References Cited

U.S. PATENT DOCUMENTS 4,906,201 A * 3/1990 Young et al. ..... 439/108
5,266,053 A * 11/1993 Jamet et al. ..... 439/607
5,306,175 A * 4/1994 Swanstrom ..... 439/362
5,320,554 A * 6/1994 Freer et al. ..... 439/347
5,709,569 A * 1/1998 Buck et al. ..... 439/607
5,772,471 A * 6/1998 Buck ..... 439/607
6,210,216 B1 4/2001 Tso-Chin et al.
6,305,986 B1 10/2001 Hwang

FOREIGN PATENT DOCUMENTS

TW 330735 4/1998
TW 349660 1/1999

* cited by examiner

*Primary Examiner*—Hian Vu
(74) *Attorney, Agent, or Firm*—Wei Te Chung

(57) ABSTRACT

A cable end connector assembly (1) for mating with an outer ground device (50) includes a plurality of electrical connectors (10), a cable (20), an insulative cover (40) and a grounding element (30). The cable comprises a plurality of wires (201), an outer insulative jacket (203) surrounding the wires and a metal braid positioned between the wires and the insulative jacket. The wires extend out of the jacket and electrically connect with contacts of the connectors, respectively. The insulative cover comprises a front portion (43) for the outer ground device being mounted thereon. The metal braid of the cable extends to the front portion. The grounding element is mounted to the front portion of the cover, and electrically and mechanically connects with the metal braid of the cable adapted for electrically connecting to the outer ground device.

4 Claims, 6 Drawing Sheets

CABLE END CONNECTOR ASSEMBLY WITH IMPROVED GROUNDING MEANS

CROSS-REFERENCE TO RELATED APPLICATION

This patent application is a co-pending application of U.S. patent application invented by Lin, Hsien-chu, Yu Chieh-chao, Chung, Yang-chien, and Huang, Chih-Kai entitled "CABLE END CONNECOTR ASSEMBLY WITH IMPROVED GROUNDING MEANS" and assigned to the same assignee as this patent application.

BACKGROUND' OF THE INVENTION

1. Field of the Invention

The present invention relates to a cable end connector assembly, and particularly to a cable end connector assembly having enhanced grounding effect.

2. Description of Related Art

With the developing trend of miniature of a personal computer, the integration command of a mother board is higher and higher and a plurality of electrical components is needed to be integrated thereon. Because of the limited space of a chassis of the computer, the size of the mother board is limited correspondingly, therefore, the number of the electrical components is restricted. However, with the development of consuming products, besides outer peripheral devices (such as keyboard, mouse et al.), the computer also needs to connect with other consuming products, such as a printer, a digital camera, a scanner, and a personal digital assistant (PDA). This needs a lot of input/output ports settled on a panel of the chassis to satisfy the current requirement.

Under such condition, a cable end connector assembly mounted in the chassis of the computer is developed. The cable end connector assembly interconnects the input/output ports settled on the panel and corresponding electrical connectors mounted on the mother board; thus, economizing the mother board to a great extent. Such prior art cable end connector assembly is disclosed in Taiwan patent No. 330735 issued on Apr. 21, 1998 and Taiwan patent No. 349660 issued on Jan. 1, 1999. The cable end connector assembly typically comprises a plurality of mating ports. Each mating port disclosed in the patents is fastened to a grounding plate by a pair of screws. A metal shield enclosing the mating port abuts against the grounding plate which is assembled on the panel of the chassis of the computer. Therefore, the cable end connector assembly is grounded by the panel. Now referring to FIGS. 7 and 8, such a cable end connector assembly will be described in detail. An electrical connector 10' of the cable end connector assembly comprises an insulative housing 112', a plurality of contacts 113' respectively received in channels defined in the housing 112', and a metal shield 101' enclosing the insulating housing 112'. Signal wires 201' of a cable 20' are soldered with the contacts 113', respectively. A metal braid of the cable 20' has an outstretched wire 202' soldered on the metal shield 101'. Thus, the connector realizes the grounding by the grounding plate abutting against the metal shield 101', and the metal braid achieves enhanced EMI protection.

However, the engagement between the metal shield and the grounding plate is influenced by the connecting screws. If the screws are not screwed down or has been used for a long time, the screws become loose, thus, the engagement between the metal shield and the grounding plate is not reliable and influences the effect of the EMI protection.

Hence, a cable end connector assembly with an improved grounding means for achieving enhanced grounding effect is required to overcome the disadvantages of the related art.

SUMMARY OF THE INVENTION

An object of the present invention is to provide a cable end connector assembly, which has a cable with a metal braid for achieving an improved grounding performance and enhanced EMI protection.

In order to achieve the objects set forth, a cable end connector assembly for mating with an outer ground device comprises a plurality of electrical connectors, a cable, an insulative cover and a grounding element. Each electrical connector comprises an insulative housing and a plurality of contacts mounted in the insulative housing. The cable comprises a plurality of wires, an outer insulative jacket surrounding the wires and a metal braid positioned between the wires and the insulative jacket. The wires extend out of the jacket and electrically connect with the contacts of the connectors. The insulative cover is over-molded with the electrical connectors and one end of the cable. The insulative cover comprises a front portion for the outer ground device being mounted thereon. The metal braid extends to the front portion. The grounding element is mounted to the front portion of the cover and electrically and mechanically connects with the metal braid of the cable adapted for electrically connecting to the outer ground device.

Other objects, advantages and novel features of the invention will become more apparent from the following detailed description when taken in conjunction with the accompanying drawings.

DETAILED DESCRIPTION OF THE INVENTION

Figure 1:
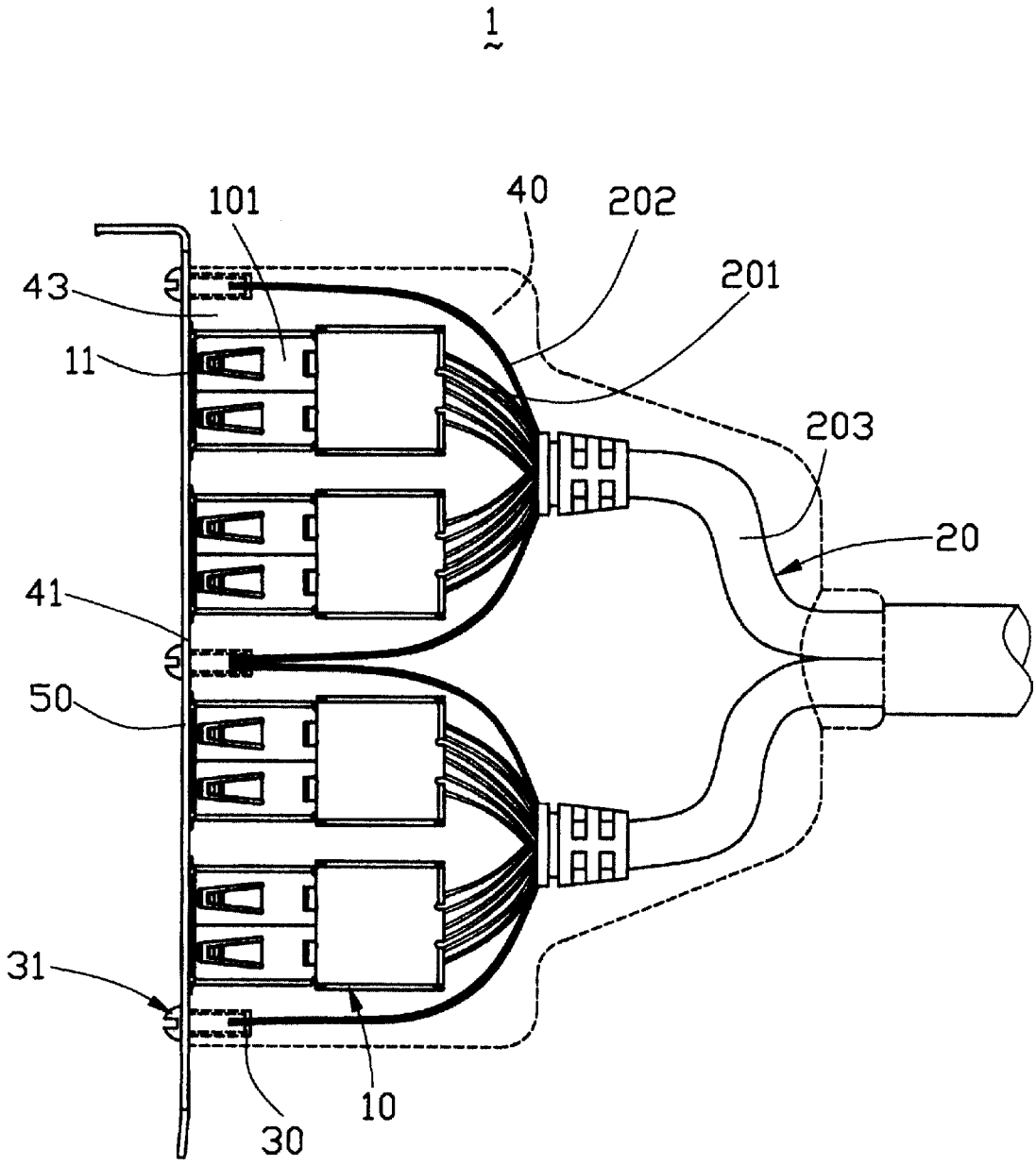
FIG. 1 is a top plan view of a cable end connector assembly of a first embodiment in accordance with the present invention with a cover in a perspective view.

Referring to FIG. 1, a cable end connector assembly 1 in accordance with the present invention comprises a plurality of cable end connectors 10, a plurality of cables 20, a plurality of grounding elements 30, and an insulative cover 40. A grounding plate 50 is mounted adjacent to mating portions 12 (referring to FIG. 4) of the cable end connectors 10.

In this embodiment shown, the plurality of cable end connectors 10 are four Universal Serial Bus (USB) connectors. Since the USB connector is skilled in the prior art, no details are given herein. The cables 20 connect with the cable end connectors 10 and each cable 20 comprises a plurality of wires 201 for transmitting signals, an outer insulative jacket 203 surrounding the wires 201, and a metal braid positioned between the wires 201 and the outer insulative jacket 203. A plurality of outstretched wires 202 stretch from the metal braid. The signal wires 201 electrically connect contacts (not shown) of the cable end connectors 10 and the outstretched wires 202 are soldered on metal shields 101 of the cable end connectors 10, respectively.

The insulative cover 40 is preferably comprised of molded plastic or polymer material and over molded with the cable end connectors 10 and front ends of the cables 20. The insulative cover 40 has a front portion 43 which has a front surface 41 substantially coplanar with a mating surface 11 of the metal shield 101. The insulative cover 40 can also be a pair of covers fastened with each other by a plurality of screws.

The grounding elements 30 are made of conductive material and each is in the shape of column. The grounding elements 30 are inlaid in the front portion 43 of the cover 40 beside the cable end connectors 10 and each defines a thread hole therein. In this embodiment, there are three grounding elements 30 mounted in the front portion 43 and adjacent to the front face 41 of the insulative cover 40 closely. One grounding element 30 locates in the middle and the other two grounding elements 30 locate on opposite ends of the cover 40.

In this embodiment, the outstretched wires 202 are also soldered with the grounding elements 30, respectively, so as to form electrical and mechanical connection therebetween.

Figure 4:
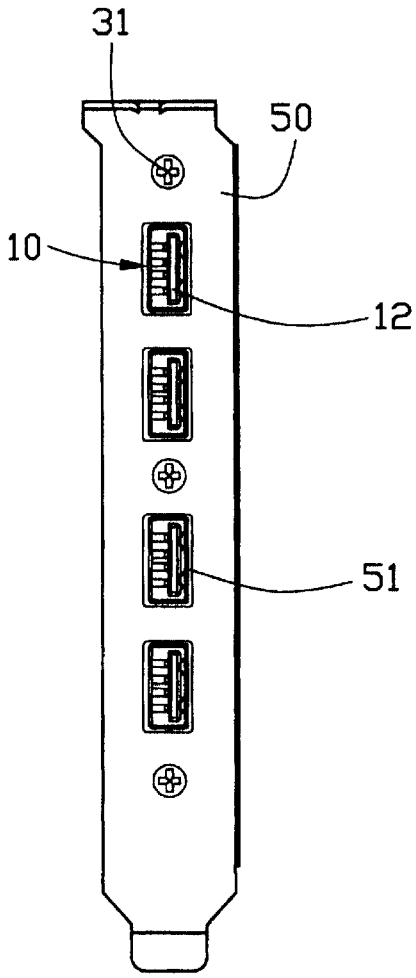
FIG. 4 is a corporate front elevational view of the cable end connector assemblies of FIGS. 1 and 3.
Figure 5:
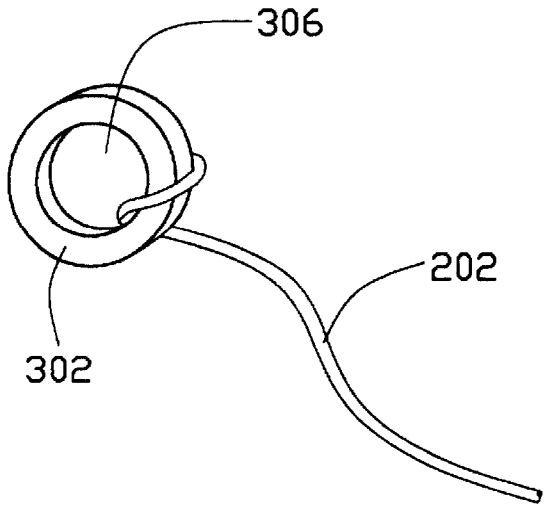
FIG. 5 is a corporate perspective view of an outstretched wire of a metal braid of a cable connecting with a gasket of FIGS. 2 and 3.

Referring to FIG. 4, the grounding plate 50 is long and narrow. The grounding plate 50 is assembled to the front surface 41 of the insulative cover 40 and the size thereof is larger than that of the front surface 41. A plurality of rectangular openings 51 is defined in the grounding plate 50 and aligns with the mating portions 12 of the cable end connectors 10 for providing the mating portions 12 extending therethrough. The grounding plate 50 also defines a plurality of holes (not shown) therein for providing a plurality of screws 31 protruding therethrough.

The screws 31 protrude through the holes and screw with inner thread holes of the grounding elements 30. Thus, the grounding plate 50 is fastened to the cable end connector assembly 1 securely. Meanwhile, the mating surfaces 11 of the metal shields 101 of the cable end connectors 10 abut against the grounding plate 50, and an electrical grounding trace between the metal braids of the cables 20 and the grounding plate 50 is established via the grounding elements 30.

After the assembly of the grounding plate 50 to the cable end connector assembly 1, the grounding plate 50 are grounded from a panel of a chassis of a computer on which the grounding plate 50 is assembled. Because of the existence of the electrical trace, the metal shields 101 of the cable end connectors 10 and the metal braids of the cables 20 are also grounded from the panel.

Therefore, even if the mating faces 11 of the metal shields 101 are separated from the grounding plate 50 and cause an unstable contact with the grounding plate 50, the metal braids of the cables 20 can still be grounded stably from the panel by means of the reliable connection between the grounding elements 30 and the grounding plate 50. Accordingly, the enhanced EMI protection is assured.

However, in alternate embodiments, any suitable type and number of electrical connectors can achieve the same ground effect. In alternate embodiments, the outstretched wires 202 are half bare wires, or surrounded by outer insulative jackets with skinned front ends thereof exposed outwardly.

Figure 2:
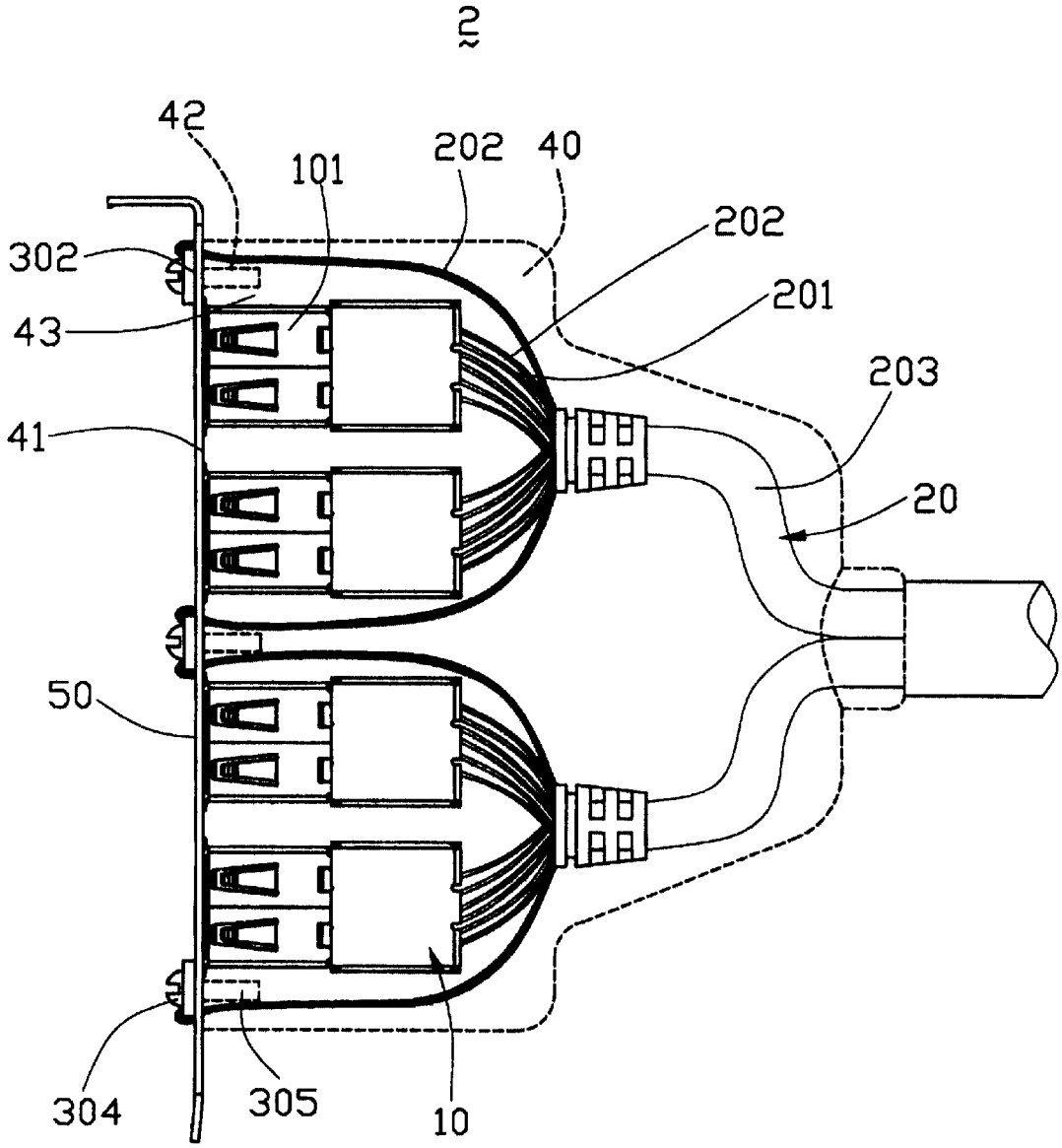
FIG. 2 is a top plan view of a cable end connector assembly of a second embodiment in accordance with the present invention with a cover in a perspective view.
Figure 3:
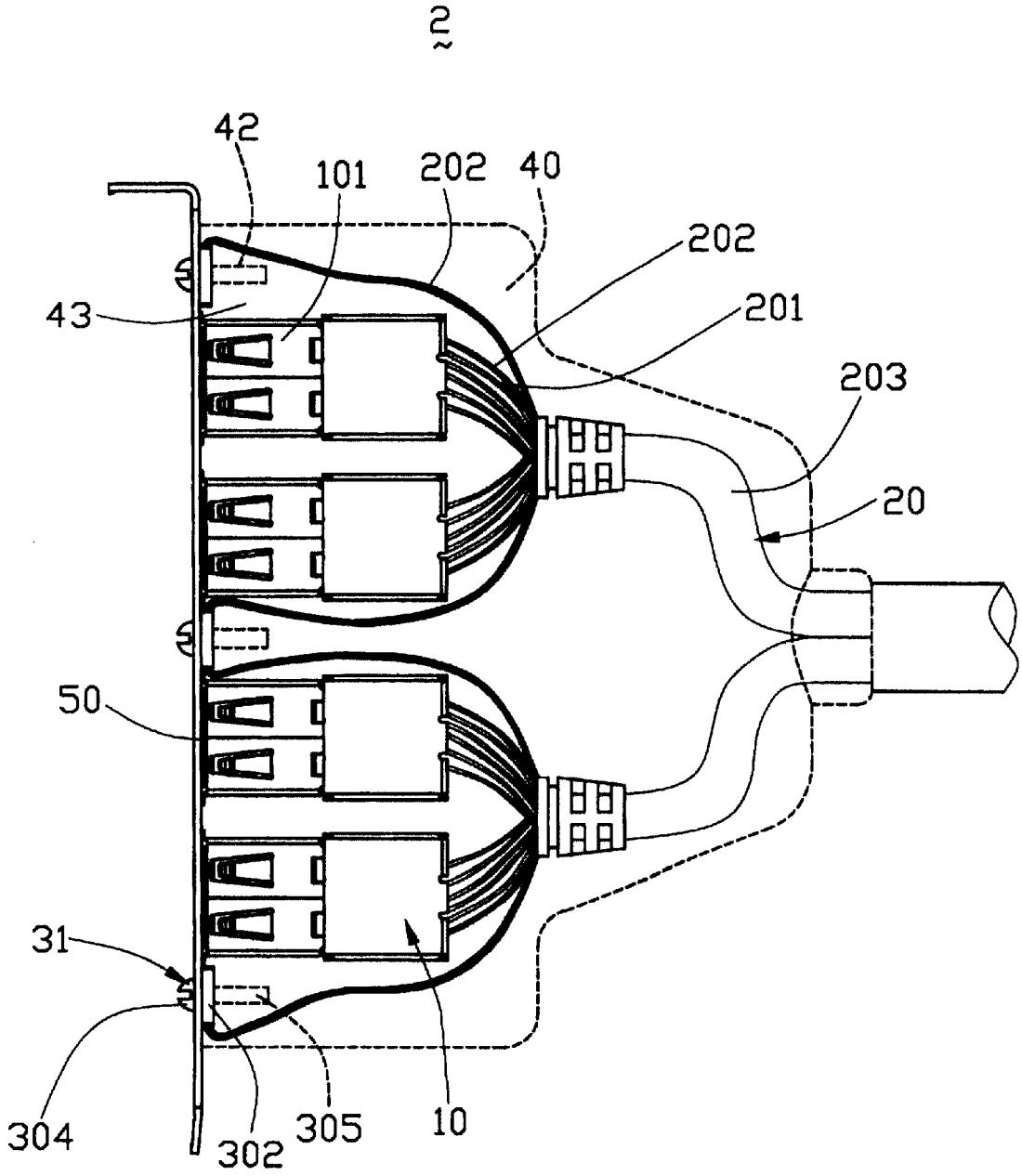
FIG. 3 is another top plan view of the cable end connector assembly of the second embodiment in accordance with the present invention, with a cover in a perspective view.
Figure 7:
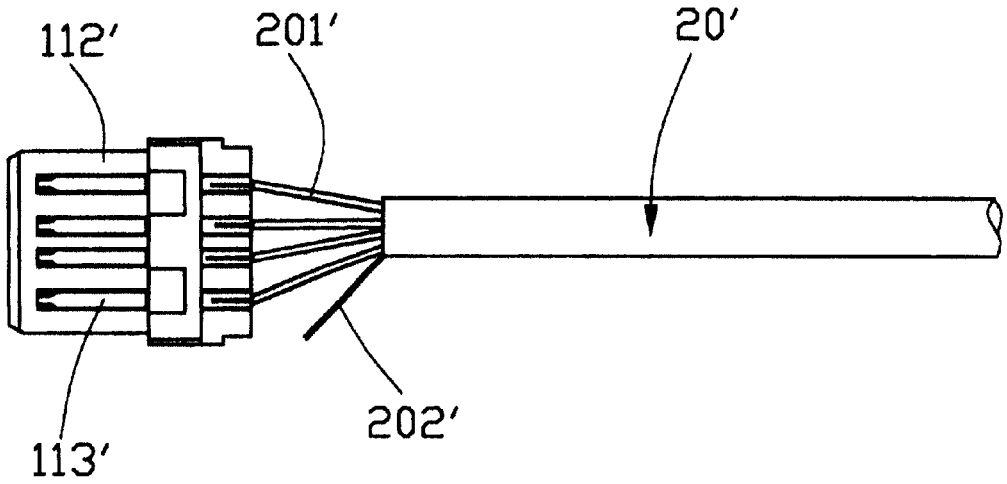
FIG. 7 (PRIOR ART)
FIG. 7 is a top plan view of a conventional cable end connector assembly, illustrating the connection between a cable end connector and a cable, with signal wires of the cable soldered with contacts of the connector, respectively.
Figure 8:
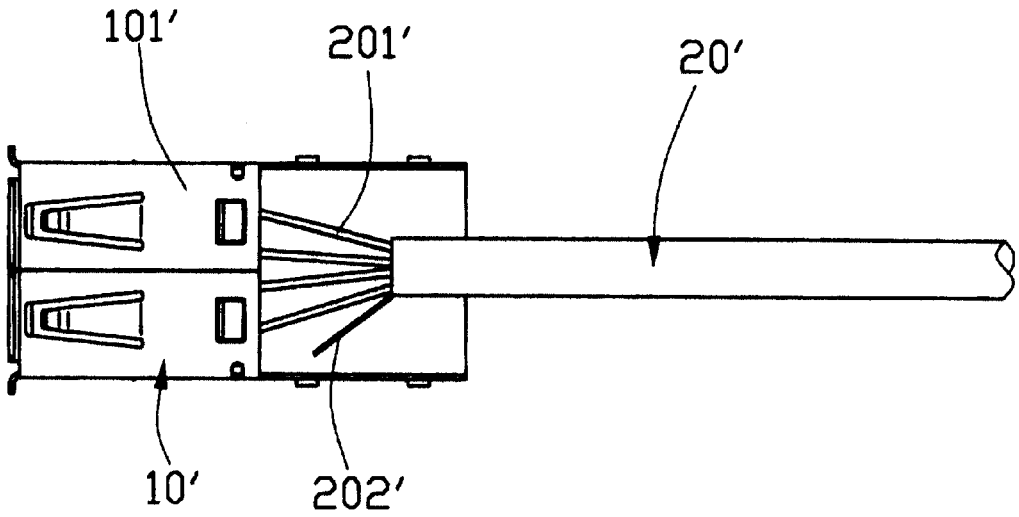
FIG. 8 (PRIOR ART)
FIG. 8 is a view similar to FIG. 7 with a metal braid of the cable soldered with a metal shield of the connector.

FIGS. 2 and 3 shows two cases in accordance with a second embodiment. A cable end connector assembly 2 has a same construction as that of the cable end connector assembly 1 described in the first embodiment except that the grounding elements 30 are replaced by grounding elements 302. Corresponding to the positions of the grounding elements 30, a plurality of thread holes 42 is defined inwardly on the front surface 41 of the front portion 43 of the insulative cover 40 for receiving the screws 31 therein. Referring to FIG. 7, the grounding element 302 is a ring-shaped gasket defining a round hole 306 therein. The outstretched wires 202 are mechanically wrapped or soldered with the grounding elements 302, respectively.

A first case of the second embodiment is shown in FIG. 2, each grounding element 302 connected with corresponding outstretched wire 202 is positioned between a cap 304 of corresponding screw 31 and the grounding plate 50, and a body portion 305 of each screw 31 with threads on an out surface thereof protrudes through the round hole 306 of the grounding element 302 and a corresponding hole of the grounding plate 50 in turn, and is fastened in corresponding thread hole 42 of the insulative cover 40. Thus, the grounding plate 50 is fastened to the cable end connector assembly 2 securely.

A second case of the second embodiment is shown in FIG. 3, a recess (not labeled) is defined inwardly in the front surface 41 of the front portion 43 of the insulative cover 40 corresponding to the position of each grounding element 302. Each grounding element 302 is received in corresponding recess and a front surface thereof is substantially coplanar with the front surface 41 of the insulative cover 40. The cap 304 of each screw 31 abuts against the grounding plate 50, and the body portion 305 of the screw 31 protrudes through corresponding hole of the grounding plate 50 and the round hole 306 of corresponding grounding element 302. Finally, the screw 31 is received in the thread hole 42 defined in the insulative cover 40; thus, the grounding plate 50 is fastened to the cable end connector assembly 2 securely.

Figure 6:
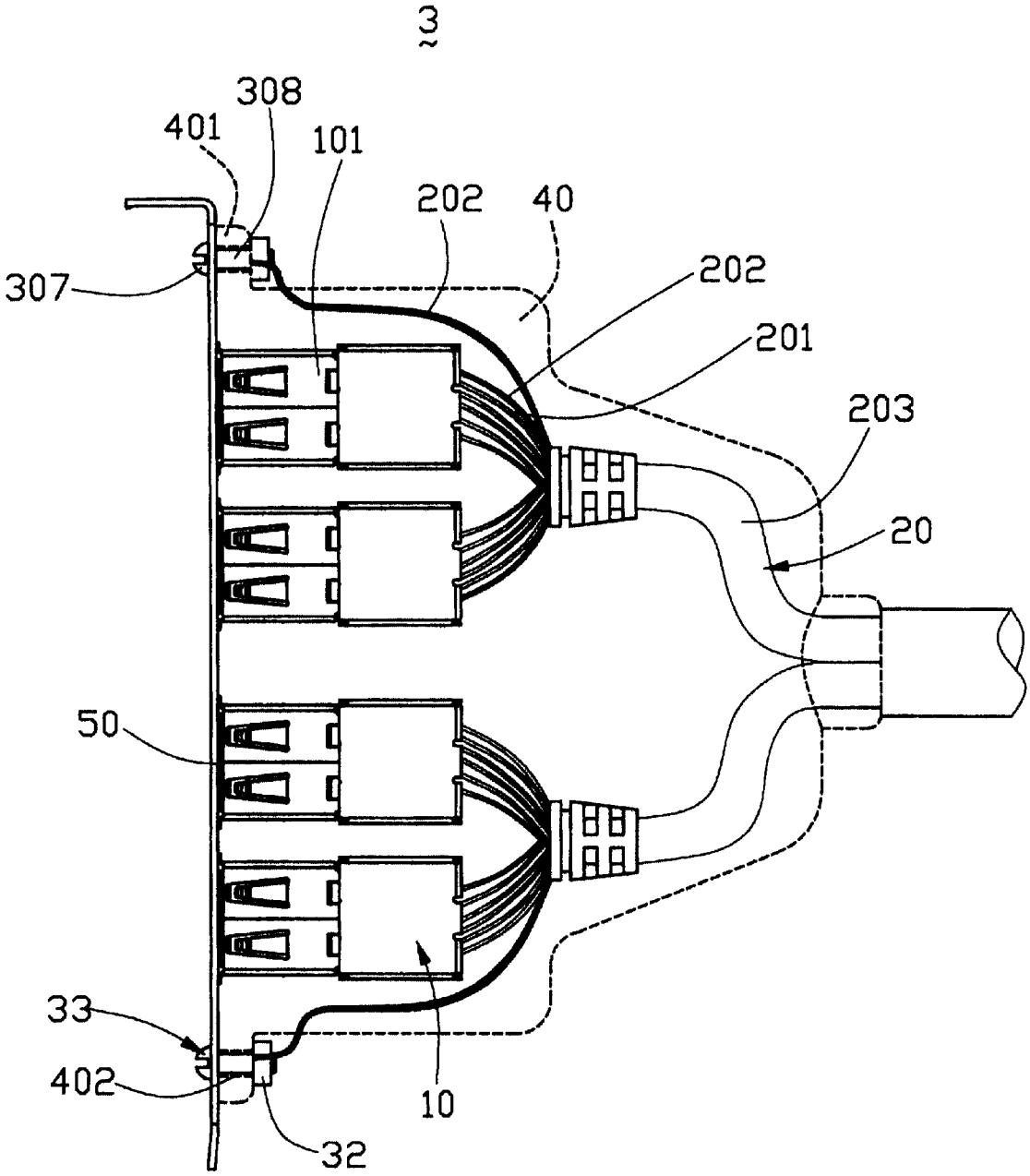
FIG. 6 is a top plan view of a cable end connector assembly of a third embodiment in accordance with the present invention with a cover in a perspective view.

Referring to FIG. 6, a cable end connector assembly 3 in accordance with a third embodiment has a same construction as that of the cable end connector assembly 1 described in the first embodiment except that a pair of ear portions 401 protrudes sidewardly from opposite ends of the insulative cover 40. Each ear portion 401 defines a through hole 402 therethrough. In this embodiment shown, the grounding element 32 is a screw nut defining a thread hole (not labeled) therein. The outstretched wires 202 are mechanically wrapped or soldered with the grounding elements 32, respectively. A cap 307 of a screw bolt 33 abuts against the grounding plate 50, and a body portion 308 of the screw bolt 33 protrudes through corresponding hole of the grounding plate 50 and the through hole 402 defined in the ear portion 401 of the insulative cover 40 in turn. Finally, the body portion 308 is received in the thread hole of the grounding element 33.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly adapted for mating with an outer ground device, comprising:

a plurality of electrical connectors each comprising an insulative housing and a plurality of contacts mounted in the insulative housing;

a cable comprising a plurality of wires, an outer insulative jacket surrounding the wires and a metal braid positioned between the wires and the insulative jacket, the wires extending out of the jacket and electrically connecting with the contacts of the connectors;

an insulative cover over-molded with the electrical connectors and one end of the cable, the insulative cover comprising a front portion adapted for the outer ground device being mounted thereon, the metal braid extending to the front portion; and a grounding element mounted to the front portion of the cover, and electrically and mechanically connecting with the metal braid of the cable adapted for electrically connecting to the outer ground device;

further comprising a plurality of metal shields each enclosing the insulative housing of corresponding electrical connector and comprising a mating portion exposed to the front portion of the cover adapted for abutting against the outer grounding device; wherein the metal braid of the cable comprises a plurality of outstretched wires stretching therefrom and being soldered with the metal shield of corresponding electrical connector; wherein the outstretched wires of the metal braid of the cable are mechanically wrapped or soldered with the grounding element; wherein the insulative cover defines a hole therein adapted for receiving a screw; wherein the grounding element is a ring-shaped gasket defining a round hole therein adapted for extending therethrough with the screw.

2. The cable end connector assembly as claimed in claim 1, wherein the insulative cover forms a pair of ear portions protruding sidewardly from a pair of opposite sides thereof, each ear portion defines a through hole therein adapted for extending therethrough with the screw.

3. A set of electric assembly, comprising:

a cable end connector assembly, comprising:

a plurality of electrical connectors, each comprising an insulative housing and a plurality of contacts mounted in the insulative housing;

a cable comprising a plurality of wires, an outer insulative jacket surrounding the wires, and a metal braid positioned between the wires and the insulative jacket, the wires electrically connecting with the contacts, respectively;

an insulative cover over-molded with the electrical connectors and one end of the cable, the cover comprising a front portion; and a ground plate abutting against a front surface of the front portion of the insulative cover;

a grounding element electrically and mechanically connecting with the metal braid of the cable and electrically connecting with the ground plate; wherein the grounding element is a ring-shaped gasket defining a round hole therein adapted for extending therethrough with the screw; wherein each electrical connector further comprises a metal shield enclosing the insulative housing, the metal braid comprises a plurality of outstretched wires stretching from the metal braid and being soldered with corresponding metal shield; wherein the grounding plate is long and narrow and comprises a plurality of openings corresponding to positions of mating portions of the electrical connectors and a hole for the screw protruding through.

4. The cable end connector assembly as claimed in claim 3, wherein the grounding element is positioned between a cap of the screw and the grounding plate.

* * * * *